United States Patent [19]

Scheidegger

[11] Patent Number: 4,947,627

[45] Date of Patent: Aug. 14, 1990

[54] HEAT-SHRUNK THREADED BOTTLE CAP

[75] Inventor: Albert Scheidegger, Villeurbanne, France

[73] Assignee: Etablissements Scheidegger W. & Cie S.A., Villeurbanne, France

[21] Appl. No.: 272,219

[22] Filed: Nov. 16, 1988

Related U.S. Application Data

[62] Division of Ser. No. 942,523, Dec. 16, 1986, Pat. No. 4,803,829.

[30] Foreign Application Priority Data

Jan. 27, 1986 [FR] France ..... 86 01408

[51] Int. Cl.[5] ..... B65B 7/28; B65B 53/02; B67B 3/04; B67B 1/02

[52] U.S. Cl. ..... 53/557; 53/290; 53/295; 53/296; 53/307; 53/329

[58] Field of Search ..... 53/471, 478, 442, 290, 53/291, 295, 487, 489, 488, 490, 557, 307, 329, 296; 156/84, 86

[56] References Cited

U.S. PATENT DOCUMENTS

| | | | |
|---|---|---|---|
| 825,116 | 7/1906 | Engels | 53/478 |
| 2,068,107 | 1/1937 | Nygard | 53/291 |
| 2,666,542 | 1/1954 | Price | 53/478 X |
| 2,790,285 | 4/1957 | Pike et al. | 53/478 |
| 2,790,286 | 4/1957 | Snyder | 53/478 |
| 2,885,105 | 5/1959 | Heyl et al. | 53/487 X |
| 3,417,539 | 12/1968 | Hirohama | 53/442 X |
| 4,387,553 | 6/1983 | Strub et al. | 53/291 X |
| 4,430,142 | 2/1984 | Ochi et al. | 53/478 X |

FOREIGN PATENT DOCUMENTS 2560156 8/1985 France .

*Primary Examiner*—Horace M. Culver
*Attorney, Agent, or Firm*—Browdy and Neimark

[57] ABSTRACT

A recipient having an axially upwardly open neck formed with at least one radially projecting neck thread is capped by fitting a circumferentially thermally shrinkable sleeve around a plug, fitting the plug into the open neck to block same, fitting the sleeve also around the neck over the neck thread, and heating the sleeve and thermally shrinking it circumferentially into tight engagement with the plug and with the neck and neck thread. The sleeve can be first fitted around the plug and then shrunk over the plug, after which the plug and sleeve are fitted together to the recipient, whereupon the sleeve is shrunk over the neck. Alternately the plug is fitted to the neck, then at the same time the sleeve is fitted around the plug and around the neck, and then the sleeve is heated to shrink it onto the plug and neck at the same time.

4 Claims, 3 Drawing Sheets

HEAT-SHRUNK THREADED BOTTLE CAP

This is a division of application Ser. No. 942,523 filed Dec. 16, 1986 and now U.S. Pat. No. 4,803,829.

FIELD OF THE INVENTION

The present invention relates to a threaded bottle cap. More particularly this invention concerns such a cap and a method of and apparatus for making same.

BACKGROUND OF THE INVENTION

A standard two-part cap for a recipient, hereinafter referred to as a bottle, typically has a plug of cork or thick plastic material that is inserted in the neck of the bottle, and a collar or sleeve surrounding this plug and the neck of the bottle. Once the bottle is filled, the plug is fitted in place, and then the sleeve is fitted around the neck. Such an arrangement can form the sleeve by coating the plugged neck of the bottle in a material that hardens to form the sleeve or as described in French Pat. No. 2,560,156 of Gerard Delval and U.S. Pat. No. 4,497,156 by shrinking the sleeve in place.

When the neck of the bottle has a thread so that the cap is replaceable, it is standard practice to form the sleeve of an aluminum foil that is pressed against the neck so as to shape the threads in it. Although fairly weak and rather expensive to manufacture, such a cap can be reused several times before the threads give out.

OBJECTS OF THE INVENTION

It is an object of the present invention to provide an improved bottle cap.

Another object is the provision of an improved method of and apparatus for making such a cap which allows a fairly rugged threaded cap to be produced at very low cost.

SUMMARY OF THE INVENTION

A recipient having an axially upwardly open neck formed with at least one radially projecting neck thread is capped by fitting a circumferentially thermally shrinkable sleeve around a plug, fitting the plug into the open neck to block same, fitting the sleeve also around the neck over the neck thread, and heating the sleeve and thermally shrinking it circumferentially into tight engagement with the plug and with the neck and neck thread. The sleeve can be first fitted around the plug and then shrunk over the plug, after which the plug and sleeve are fitted together to the recipient, whereupon the sleeve is shrunk over the neck. Alternately the plug is fitted to the neck, then at the same time the sleeve is fitted around the plug and around the neck, and then the sleeve is heated to shrink it onto the plug and neck at the same time.

Such a method forms surprisingly solid threads that can be reused quite a bit. The method works very rapidly and produces and extremely tight and inexpensive cap.

When the sleeve is heat shrunk around the plug to form therewith a preform, only that portion of the sleeve juxtaposed with the thread is subsequently heated. A mandrel is used to hold the plug and to limit the shrinkage of the sleeve in such an operation. The mandrel tapers toward the plug for easy removal of the preform.

According to another feature of this invention the sleeve is formed in a lower region with an annular tear line and the neck is formed below the neck thread with an annular radially outwardly open groove. The tear line is positioned slightly above the groove before shrinking the sleeve which is shrunk below the tear line into the groove to make a cap that clearly indicates whether the recipient has been opened or tampered with.

In order to have sufficient material to form the screwthread in the sleeve, the sleeve is preformed with a radially outwardly convex annular bulge that is level with the neck thread during shrinking. The rectified length of the bulged portion is the same as that of the threaded portion. This makes the thread in the sleeve very strong.

In addition the plug is formed with radially extending grooves that serve to angularly link the sleeve and plug. The sleeve itself according to this invention is of polyvinyl chloride and is heated at between 300° C. and 400° C. for at least 1 secondand thereafter cooled to between 120° C. and 140° C. to heat shrink it.

The apparatus for carrying out the method of this invention has a sleeve conveyor defining a path for a succession of the sleeves and a recipient conveyor defining a path for a succession of the recipients at least partially contiguous with the sleeve path. The sleeve conveyor has a succession of mandrels on which sleeves are mounted and then shrunk, then removed for mounting on the normally filled recipients.

The mandrels each have a core, a ring displaceable along the core to push a sleeve off the core, a radially expansible ring on the core engageable internally with a sleeve on the core, and cams engageable with the rings for displacing same and thereby expanding the expansible ring before preshrinking of the sleeve and for pushing the sleeve off the core with the displaceable ring after the preshrinking. This equipment automates the manufacture of the sleeve preform.

The core forms an annular space provided with a sleeve constituting the cam for the expansible rings and each mandrel has a spring urging the displaceable ring into a position permitting a shrinkable sleeve over the core at the expansible rings.

The cap according to this invention therefore comprises a plug engageable in the neck and substantially closing same and a sleeve circumferentially heat-shrunk onto the neck and plug and complementary fitting same and the neck thread. The sleeve is a unidirectionally thermoshrinking synthetic resin with its shrinking direction extending circumferentially of the neck. The threads formed in the sleeve apparently rigidify it substantially, so that even when the wall thickness of the sleeve is relatively small, it remains rigid enough to retain its shape even after repeated screwing and unscrewing. In addition the plug has an upper edge that is formed with radial grooves and the sleeve complementarily fits these radial grooves. The bottle or recipient neck is formed with a radially outwardly open annular recess below the screw thread and the sleeve is formed with a lower end complementarily fitting within the recess and immediately above the recess with an annular weakened tear line.

DESCRIPTION OF THE DRAWING

The above and other features and advantages will become more readily apparent from the following, reference being made to the accompanying drawing in which.

SPECIFIC DESCRIPTION

Figure 1:
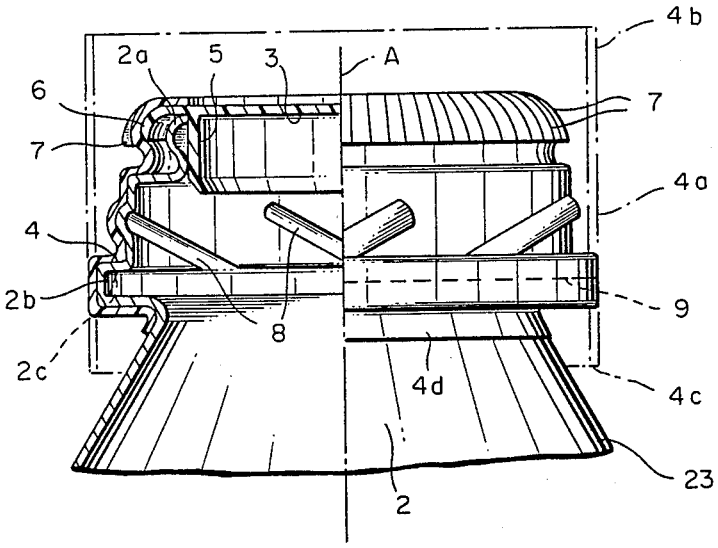
FIG. 1 is a partial axial section in enlarged scale of a bottle cap and bottle according to this invention.

As seen in FIG. 1 a bottle 23 has a neck 2 that has an upwardly open mouth 2*a* centered on an axis A and closed by a plug 3. A polyvinyl chloride sleeve 4 some 100 micron to 200 micron thick tightly surrounds the neck 2, conforming complementarily to it. The plug 3 has a downwardly directed annular inner rim 5 centered on the axis that fits within the mouth 2*a* and a downwardly turned outer rim 6 also centered on the axis and fitting outside over this mouth 2*a*. In addition the plug 3 is formed on its upper and outer surfaces with radially extending grooves 7. The neck 2 itself is formed below its mouth with a plurality of steeply angled screwthread formations 8 and immediately therebelow with a radially outwardly projecting rim 2*b* formed with vertical grooves 2*c*.

The sleeve 4 snugly fits over the plug 3 and neck 2, complementarily engaging over the grooves 7, the threads 8, the ridge 2*b*, and the grooves 2*c*. In addition this sleeve 4 is formed in the upper region of the ridge 2*b* with a tear line 9 formed by an annular row of weakenings or perforations. Since the lower end of the sleeve 4 is locked underneath the ridge 2*b* and the upper end engages over the top of the plug 3, and since the lower end is rotationally locked below the line 9 to the grooves 2*c* and the upper end is rotationally locked by the grooves 7 to the plug 3, forced rotation of the top will cause the sleeve 4 to separate at the line 9. The cap 3, 4 will therefore indicate whether it has been opened or tampered with.

Figure 3:
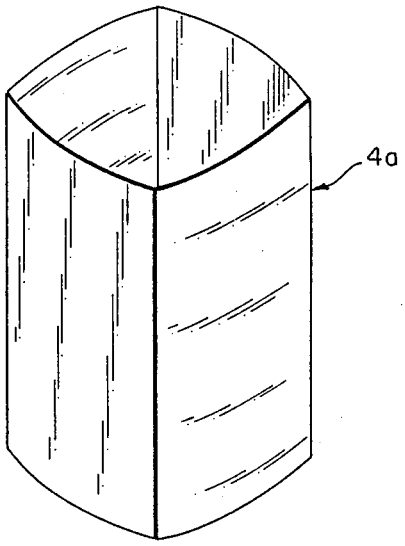
FIG. 3 is a perspective view of an unformed sleeve for the cap of this invention.

As illustrated in dot-dash lines in FIG. 1 the sleeve 4 is made from a cylindrical PVC preform 4*a* having an upper end 4*b* and a lower end 4*c*. Either of two basic procedures can be used:

1. The plug 3 is fitted in the mouth 2*a* of the neck 2, then the preform 4*a*, which may be of rounded-corner section as illustrated in FIG. 3, is fitted over it and the entire preform 4*a* is heated for at least 1 second to 300° C. to 400° C. so that it shrinks to the shown shape. This makes the upper end 4*b* wrap complementarily tightly over the cap 3 and the lower end 4*b* wrap tightly under the rim 2*b*, forming the sleeve 4 shown in solid lines in FIG. 1.

Figure 2:
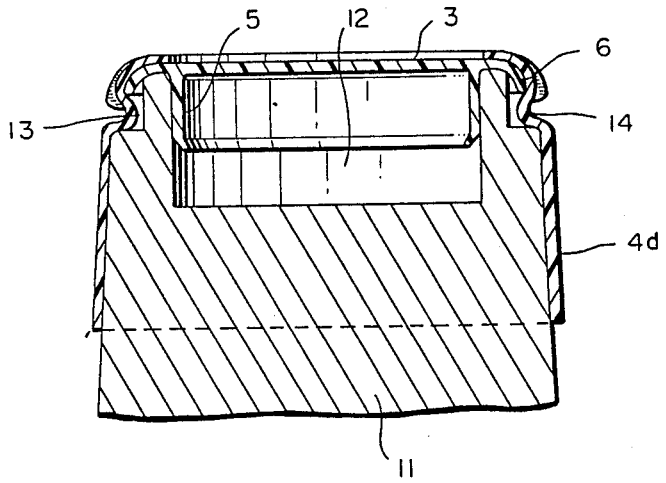
FIG. 2 is an axial section through a cap preform and a forming mandrel according to the invention.

2. The plug 3 is fitted as seen in FIG. 2 to an upwardly open cylindrical cavity 12 of a mandrel 11 having an inwardly stepped upper end 13 and an upwardly tapering frustoconical outer surface. Then the preform 4*a* is fitted to this plug 3 in the mandrel 11 and is heated as described above so that it marries the form of these elements, forming an inwardly projecting ridge 14 in the recess 13 under the outer rim 6 of the plug 3. The preform 4*d* thus formed is then fitted with the plug 3 to a filled bottle and heated so that it forms the sleeve 4. The advantage of this system is that the plug-sleeve unit can be provided to the supplier in easy-to-handle form for a relatively simple capping machine.

Figure 4:
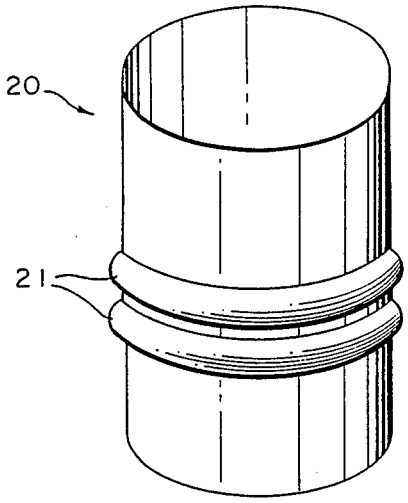
FIG. 4 is a view like FIG. 3 of a variant on the cap of this invention.
Figure 5:
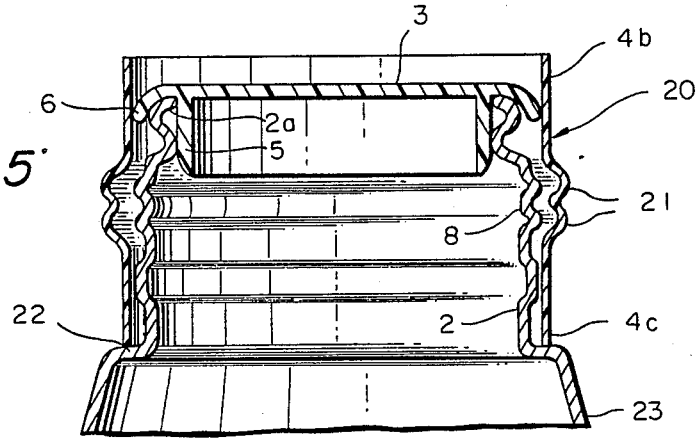
FIGS. 5 and 6 are views showing the use of the preform of FIG. 4 before and after it is shrunk onto the bottle neck.
Figure 6:
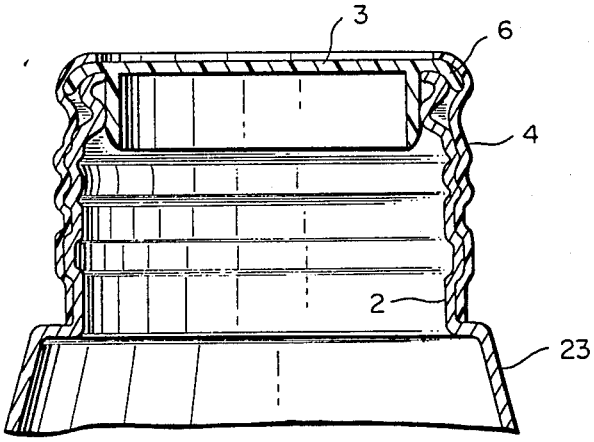

FIG. 4 shows a preform 20 that has a central region formed with two radially outwardly projecting ridges or bulges 21. As seen in FIGS. 5 and 6 this preform 20 is used by positioning its bulges 21 so they are radially level with the screwthreads 8, with the lower end 4*c* resting on a shoulder 22 of the bottle 22. Then the entire sleeve 20 is shrunk. The extra material in the bulges 21 allows adequate deformation to perfectly form over the screwthreads 8.

Figure 7:
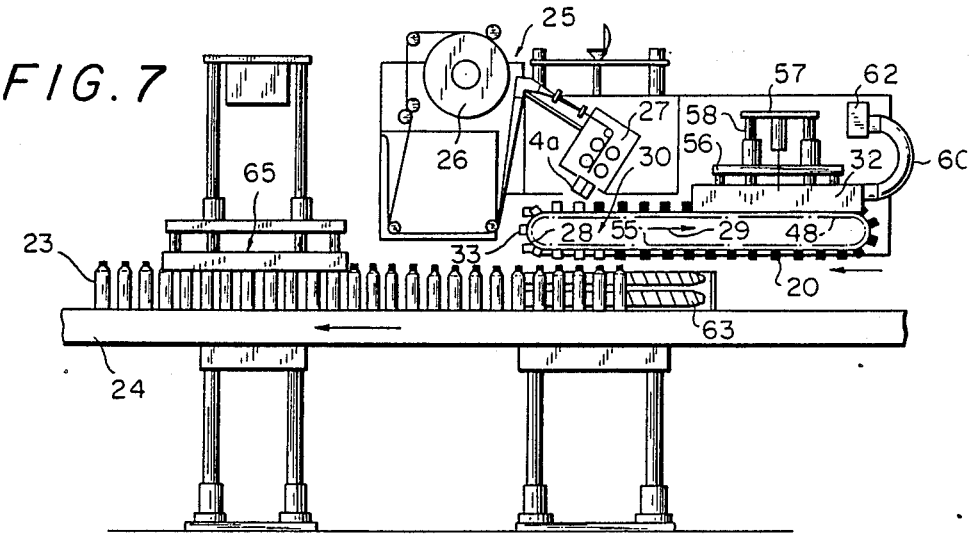
FIG. 7 is a small-scale and partly schematic side view of an apparatus for capping bottles according to this invention.

FIG. 7 shows a machine for making and using preforms 20 like that shown in FIGS. 4 through 6. This apparatus has a stepping conveyor 24 equipped with two drive screws 63 for displacing a succession of bottles 23 continuously in a direction D from right to left in FIG. 7, and another endless conveyor 28 whose upper stretch is oppositely driven as shown by arrow 29 and which carries a plurality of identical mandrels 33.

A sleeve supply 25 has a roll of tubular plastic material that is cut into sections and delivered as sleeves 4*a* to the mandrels 33 (See above-mentioned French patent 2,503,689). Downstream in direction 29 these sleeves are shrunk by a heat chamber 32 that is supplied hot air via a duct 60 and a heater/blower 62. This chamber 32 is carried on a frame 56 that can be moved up and down relative to a support 57 by cylinders 58 in time with the steps of the conveyor 28 to form the sleeves 4*a* into preforms 20.

Figure 8:
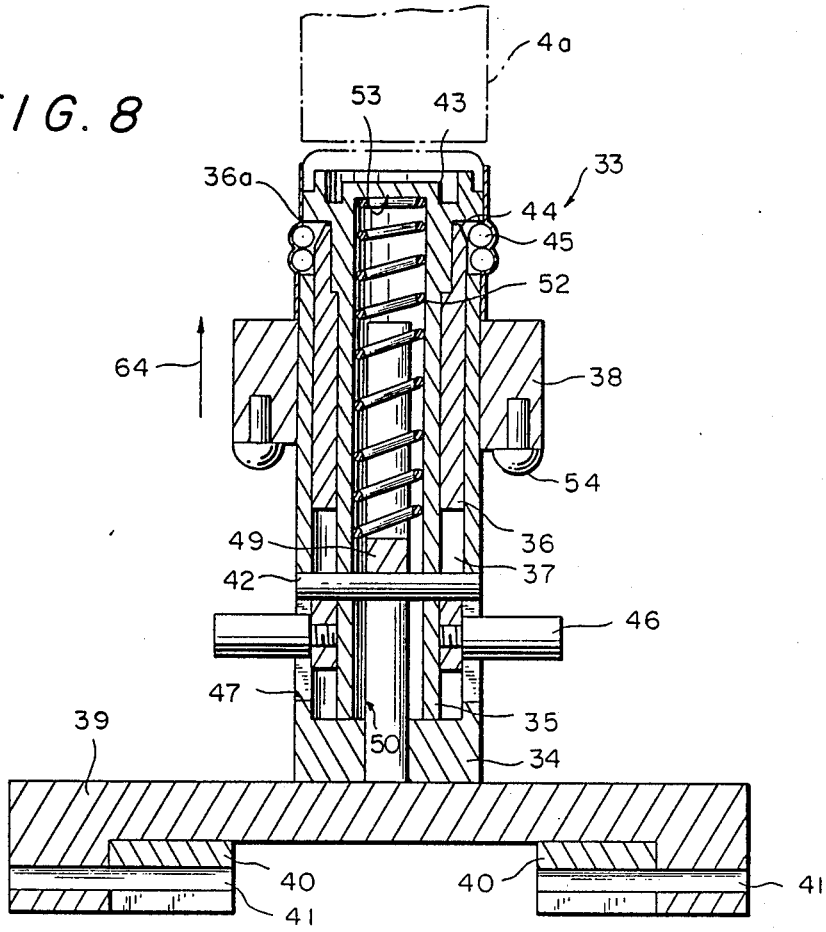
FIG. 8 is a large-scale axial section through a detail of the apparatus of FIG. 7.

The mandrels 33 as shown in FIG. 8 are carried on individual links 39 secured via pins 41 to toothed belts 40 forming the conveyor 28. Each mandrel has a tubular base 34 formed with two diametrally aligned slots 47 and by a central element 43 secured in the base 34 by a diametral pin 42. A sleeve 36 is axially movable in the space 37 between the base 34 and the center part 43 and has a pair of diametrally opposite pins 46 projecting through the slots 47. This sleeve 36 has a chamfered upper end 36*a* that can push out two radially expansible split spring rings 45 that otherwise normally line in a seat 44 formed between the upper end of the sleeve 36 and the lower end of the head of the core element 43.

A ring 38 vertically slidable on the tubular base 34 has a central crosspiece 49 projecting diametrally through aligned slots 50 in the base 34. A spring 52 has its upper end braced against the inner surface 53 of the part 43 and a lower end against the crosspiece 40 to hold the ring 38 in the illustrated lower position. The lower surface of this ring 38 is provided with bumpers 54.

The diameter of the parts 34 and 43 is slightly smaller than that of the sleeves 4*a* so that same can be dropped on the mandrels 33 to rest on the ring 38 which is normally in the illustrated down position, and for such loading the sleeve 36 is also in the down position so that the rings 45 lie within the surface defined by the parts 34 and 43.

As the sleeves 4*a* move downstream on the mandrels 33 from the loading station at the supply device 25 to the preshrinking chamber 32, the pins 46 ride on cams 48 which push up the sleeve 36 and radially expand the rings 45. Thus when the sleeve 4*a* is preshrunk it will be formed with bulges such as shown at 21 in FIGS. 4 and 5.

The thus formed preform 20*a* then cools and the pins 46 ride off the cams 48 so that the spring rings 45 push the part 36 down, and as the conveyor 28 reverses to move synchronously with the filled and plugged bottles 23, the bumpers 54 ride up on a further cam 55 and push the preforms 20 off the mandrels 33 onto these bottles 23 at an ejection station 30. Thereafter the bottles 23 carrying their plugs and preforms 20 move under another heating device 65 which shrinks the sleeves down further to form the cap of FIG. 1.

It is also possible to form the top of the part 43 with a recess to receive the rim 5 of the plug 3 so that a preform such as shown at **4*d* in FIG. 2 can be formed. In this case it is necessary to invert the thus formed preforms 4*d* before putting them on the bottles 23**.

I claim:

1. An apparatus for capping a recipient having an axially upwardly open neck formed with at least one radially projecting neck thread, the apparatus comprising:

means for conveying said recipient;

means for fitting a circumferentially thermally shrinkable sleeve around a plug;

means for fitting the plug into the open neck to block same;

means for fitting the sleeve also around the neck over the neck thread;

a mandrel first heating means for heating and thermally shrinking said sleeve circumferentially upon said mandrel to render said sleeve tightly engageable with the plug; and second heating means for heating and thermally shrinking said previously shrunken sleeve, while fitted over said neck and neck thread, circumferentially into tight engagement with the neck and neck thread, said second heating means being distinct from said first heating means.

2. The apparatus defined in claim 1, further comprising:

a sleeve conveyor defining a path for a succession of the sleeves;

a recipient conveyor defining a path for a succession of the recipients at least partially contiguous with the sleeve path, the sleeve conveyor having a succession of mandrels;

means for forming and mounting sleeves on the mandrels;

means for preshrinking the sleeves on the mandrels; and means for removing the preshrunk sleeves from the mandrels.

3. The apparatus defined in claim 2 the mandrels each have:

a core;

a ring displaceable along the core to push a sleeve off the core;

a radially expansible ring on the core engageable internally with a sleeve on the core; and cam means engageable with the rings for displacing same and thereby expanding the expansible ring before preshrinking of the sleeve and for pushing the sleeve off the core with the displaceable ring after the preshrinking.

4. The apparatus defined in claim 3 wherein the core forms an annular space provided with a sleeve constituting the cam means for the expansible rings, each mandrel having a spring urging the displaceable ring into a position permitting a shrinkable sleeve over the core at the expansible rings.

* * * * *